US005403432A

United States Patent [19]

Burch

[11] Patent Number: 5,403,432

[45] Date of Patent: Apr. 4, 1995

[54] SUSPENDIBLE WALLPAPER APPLICATOR

[76] Inventor: Teresa G. Burch, 153 Mountain View Dr., Lithia Springs, Ga. 30057

[21] Appl. No.: 262,153

[22] Filed: Jun. 20, 1994

[51] Int. Cl.[6] ..... E04B 2/00

[52] U.S. Cl. ..... 156/577; 156/579

[58] Field of Search ..... 156/71, 577, 579, 574; 52/DIG. 1; 81/488

[56] References Cited

U.S. PATENT DOCUMENTS

| | | | |
|---|---|---|---|
| 3,737,360 | 6/1973 | Horn | 156/577 |
| 4,711,682 | 12/1987 | Barbe et al. | 156/71 |
| 4,806,184 | 2/1989 | Shannon | 156/71 |
| 5,280,869 | 1/1994 | Ricci | 248/309.2 |
| 5,328,543 | 7/1994 | Campagna | 156/577 |

FOREIGN PATENT DOCUMENTS

| | | | |
|---|---|---|---|
| 2391083 | 1/1979 | France | 156/577 |

*Primary Examiner*—Michael W. Ball
*Assistant Examiner*—Sam Chuan Yao
*Attorney, Agent, or Firm*—Kenneth S. Watkins, Jr.

[57] ABSTRACT

A suspendible wallpaper applicator is disclosed for applying a rolled web on a wall surface. The device comprises an applicator tube containing the web roll, a longitudinal slot for dispensing the web, a longitudinal applicator lip for pressing the web to the wall surface and suspension spikes which can be pressed into the wall surface to hold the device on the wall without the attention of the user. Reclosable end caps are applied the the tube to retain the web roll in the tube when used in applying horizontal webs.

3 Claims, 3 Drawing Sheets

SUSPENDIBLE WALLPAPER APPLICATOR

BACKGROUND

Many individuals have faced the tedious and frustrating task of applying decorative webs such as wallpaper to a wall. A number of developments in the manufacturing of wallpaper have improved the situation somewhat, such as the availability of wallpaper with a water activated glue already applied to the bonding surface. However, the application of the web can still be a frustrating task.

A number of devices have been disclosed to aid in the application of the web on the wall. An example of such a device is disclosed in U.S. Pat. 4,711,682 to Barbe et al. The device comprises a polygonal casing and a longitudinal slot to feed the wallpaper and a presser member to apply the wallpaper to the wall. The device lacks a method to support the device without holding the applicator when repositioning the ladder, etc. The device would also be difficult to clean because the ends of the casing are not removable. U.S. Pat. 4, 806, 184 to Shannon discloses a wallpaper applicator with tension mechanism and hand grip. The device is complicated and would be difficult to clean and maintain. It also does not disclose a method to support the device on the wall without holding it in the hand. Many of the devices disclosed are designed to apply a web in only one direction.

Therefore, an object of the present invention is to provide a device which applies a web to a surface and is simple and easy to clean and maintain.

A further object of the present invention is to provide a device which can be easily attached to the wall to free the person to reposition the web, move a ladder or other errand requiring movement and both hands.

A further object of the present invention is to provide a device which can be used in applying a vertical or horizontal web.

Yet a further object is to provide a device which can be manufactured at a low cost.

SUMMARY

The supported wallpaper applicator addresses the shortcomings of existing devices. It quickly and easily applies wallpaper from a roll contained in the device. It can be used in any position for applying webs in different directions. It can be supported from the wall from which the web is being applied so that the user's hands are free to perform other tasks. It is simple and is easy to clean and maintain. It can be manufactured at low cost.

The device comprises a hollow, open ended tube with a longitudinal slot for holding and dispensing a roll of webbing such as wallpaper. A longitudinal applicator lip attached to the tube presses the web to the surface which is to be covered. A handle is attached to the tube to facilitate holding the device and extend the user's reach. At least one supporting spike is attached to the device with the sharp end of the spike in a position such that the spike may be pressed into the application surface to hold the device on the surface.

End caps may be fitted to the tube to retain the roll of webbing in the tube when the tube is in a vertical position. The cap fits over the end of the tube tightly enough to retain the weight of the roll and cap. The thickness of the cap edges is less than the compressed thickness of the applicator lip, so that the cap will not contact the application surface when the web is applied by the applicator lip. A slot is provided in the cap edge to allow clearance of the applicator lip.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
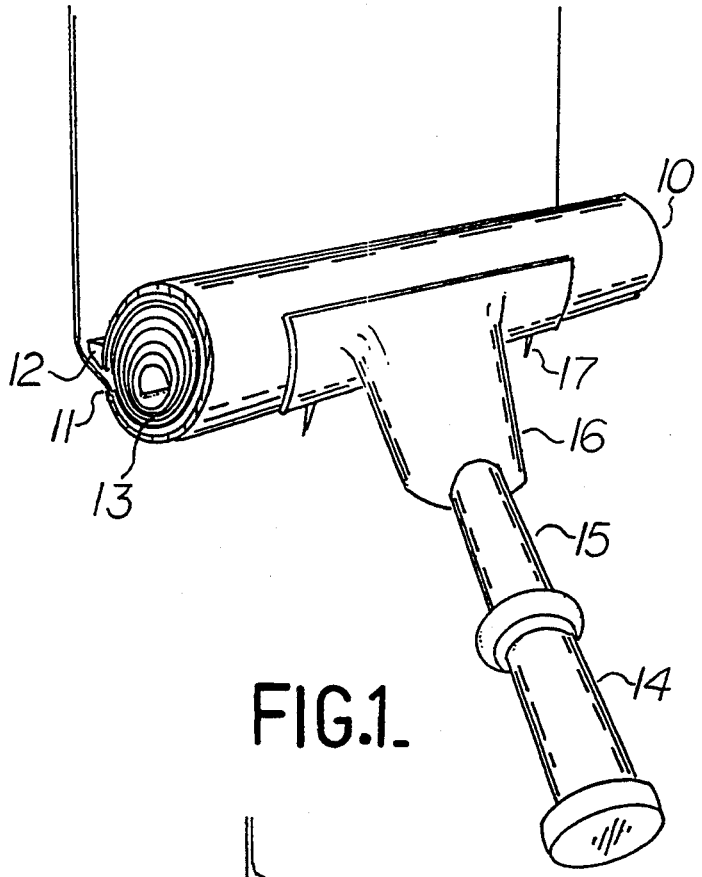
FIG. 1 is a perspective drawing of the suspendible wallpaper applicator.

FIG. 1 is a perspective drawing of the present invention. Hollow distributor tube 10 comprises a longitudinal slot 11 and longitudinal applicator lip 12 for applying a rolled web 13 on a surface such as a wall. Handle 14 is used to hold the device while applying the web, and is attached to tube 10 with extension shaft 15 and attachment adaptor 16. Handle 14 is of a rubber or plastic material and may be formed to fit the grip of the user's hand. Handle 14 is press fitted to extension shaft 15, which may be of any convenient length. Shaft 15 is press fitted into attachment adaptor 16, which in turn is bonded or fastened to tube 10. Support spikes 17 are attached to adaptor 16 and support the device when pressed into the wall surface.

Figure 2:
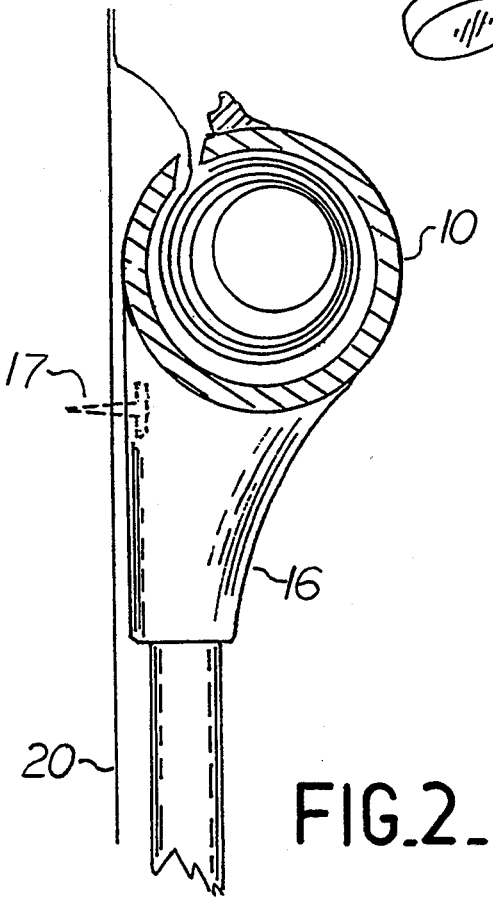
FIG. 2 is a side elevation drawing of the present invention suspended from a wall.

FIG. 2 is a drawing of the device supported on a vertical wall surface 20 by support spikes 17. The device is set by simply pressing support spikes 17 into the wall surface by applying pressure from the handle of the device, or, alternatively, adding additional pressure with the other hand against the back of tube 10. The device is released by pulling the tube away from the wall surface, or, alternatively, rotating the handle away from the wall surface. Pressing the support spikes into the wall surface is simple and easy because the wall surface will normally be of a soft wallboard or plaster material. In any case, the small holes left by the spikes are covered when the wallpaper continues.

This particularly useful feature allows the user to reposition the ladder, retrieve additional tools, wipe up spills, observe the results from a distance or simply take a break without having to hold the device.

Figure 4:
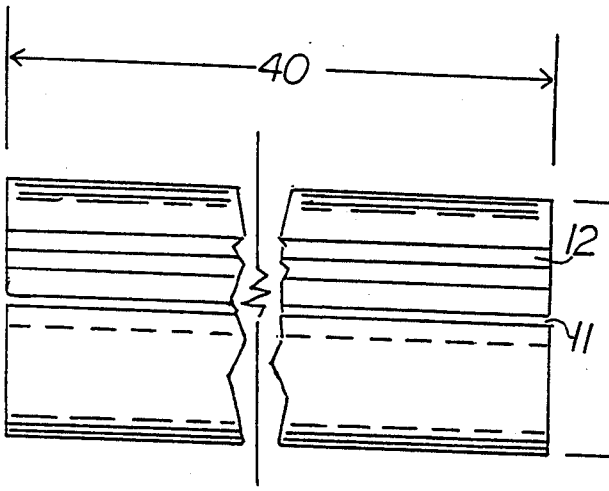
FIG. 4 is a front elevation drawing of the applicator tube.
Figure 3:
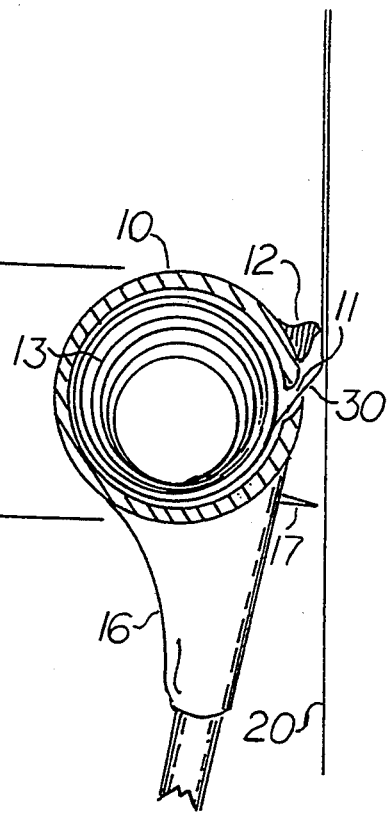
FIG. 3 is a side elevation drawing of the present invention in the operating position.

FIG. 3 is a detail end view of dispensing tube 10 with the device in use. Longitudinal slot 11 extends the full length of tube 10, shown in FIG. 4. Longitudinal applicator lip 12 is of a generally "V" shaped cross section and also extends the full length of the tube. Web 30 is dispensed from web roll 13 through longitudinal slot 11 and applied to surface 20 by applicator lip 12. The full length arrangement of slot 11 and lip 12 allows the device to apply a web against an adjoining wall which would occur in a corner. Tube length 40 is normally chosen to be equal to standard web widths.

Figure 5:
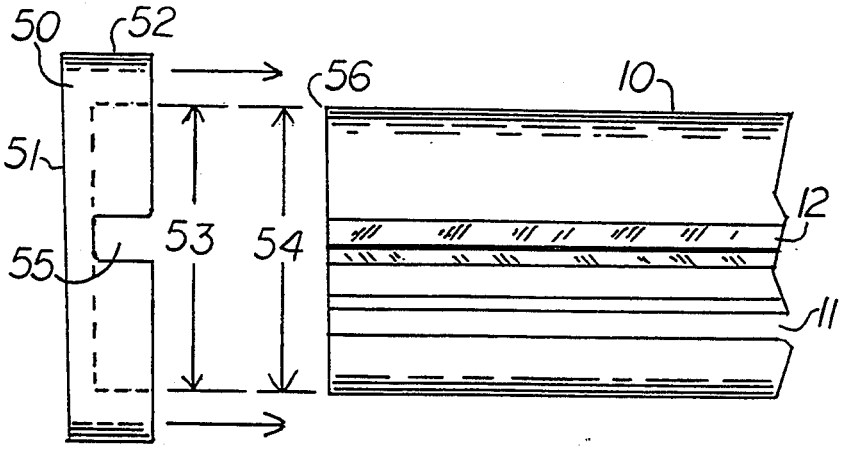
FIG. 5 is an assembly drawing of an end cap.

FIG. 5 shows end cap 50 comprising end portion 51 and tubular edge portion 52. The inner diameter 53 of tubular edge 52 is chosen to fit tightly over outer diameter 54 of tube 10. Tightly in this case is defined as sufficient to retain the cap on the tube in the vertical direction with the tube containing a wet web roll. Slot 55 in cap edge 52 gives clearance for applicator lip 12 so that cap 50 may be fully inserted on tube end 56.

Figure 6:
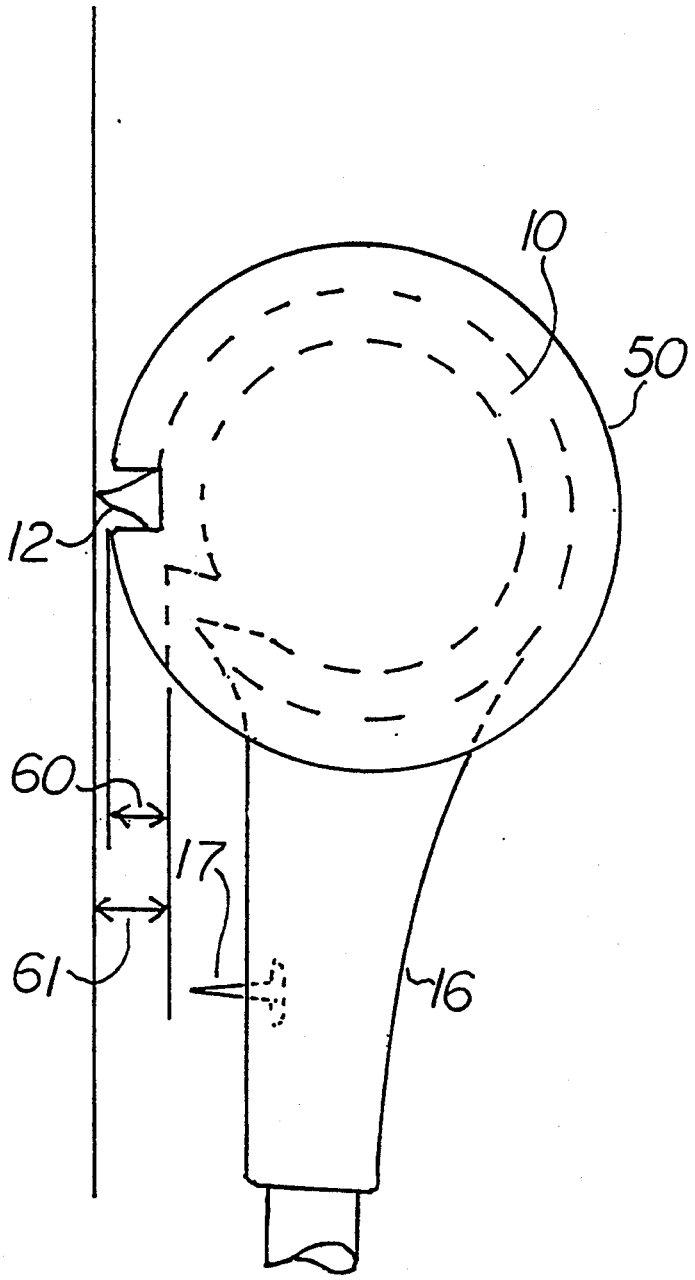
FIG. 6 is a drawing of the end cap tube edge.

Referring to FIG. 6 tubular edge thickness 60 is chosen to be less than the thickness 61 of applicator lip 12 when the lip is in its compressed working state. This edge thickness ensures that the end cap will not interfere with application of the web. End caps can be attached to retain the web roll from protruding from the end of tube 10. This is especially useful when the device is being used to apply webs in the horizontal direction (tube 10 in the vertical position). The end cap will retain the web roll in the tube and prevent excessive dripping of fluid from the tube.

The tube length (40 of FIG. 4) may be chosen for standard web widths. For short lengths such as border widths, a simple "U"-shaped handle could be used with the device.

The distributor tube, handle and shaft can be made of metal, plastic or composite materials. In its preferred embodiment, the distributor tube is made of transparent or translucent plastic so that the position of the web roll can be easily seen. The handle, shaft, adaptor flange and caps are made of plastic. The applicator lip is made of rubber or other resilient material.

Accordingly the reader will see the supported wallpaper applicator provides a device which greatly simplifies installation of wallpaper. The device comprises the following additional advantages:

it frees the user to perform tasks without holding the device against a wall continuously,
it can be loaded quickly,
it can be used in any position,
it can be used in wall corners, and
it is simple and can be manufactured at low cost.

Although the description above contains many specifications, these should not be construed as limiting the scope of the invention but as merely providing illustrations of some of the presently preferred embodiments of this invention. For example a plug may be installed to allow narrow web rolls to be used, etc.

Thus the scope of the invention should be determined by the appended claims and their legal equivalents, rather than by the examples given.

I claim:

1. A wallpaper hanging device for applying wallpaper to a surface comprising:

(a) a hollow tube further comprising a longitudinal slot for dispensing a web;
(b) a longitudinal applicator lip attached to the tube for pressing the web to the surface;
(c) a handle attached to the tube for holding the device; and
(d) at least one spike attached to the device, a sharp end of the spike positioned such that the spike may be pressed into the surface to retain the device on the surface.

2. A device as in claim 1 further comprising a removable end cap to retain a web roll in the tube, the cap having an end portion and a tubular edge portion, the tubular edge portion having an inner diameter such that the cap fits tightly over an outer diameter of an end of the tube, and the tubular edge having a thickness less than the compressed working thickness of the applicator lip, whereby the edge part of the cap will not contact the application surface when the web is applied by the applicator lip.

3. A device as in claim 2 wherein the tubular edge of the cap further comprises a slot to allow clearance of the applicator lip when the cap is inserted onto the end of the tube, wherein the applicator lip may be extended to the edge of the tube and still allow the end cap to be fully inserted on the end of the tube.

* * * * *